US008778857B2

(12) United States Patent
Growcott

(10) Patent No.: US 8,778,857 B2
(45) Date of Patent: Jul. 15, 2014

(54) LUBRICANT ADDITIVE COMPOSITIONS HAVING IMPROVED VISCOSITY INDEX INCREASE PROPERTIES

(75) Inventor: Peter Growcott, Hartley Wintney (GB)

(73) Assignee: Afton Chemical Corporation, Richmond, VA (US)

( * ) Notice: Subject to any disclaimer, the term of this patent is extended or adjusted under 35 U.S.C. 154(b) by 406 days.

(21) Appl. No.: 12/537,029

(22) Filed: Aug. 6, 2009

(65) Prior Publication Data

US 2010/0035774 A1 Feb. 11, 2010

(30) Foreign Application Priority Data

Aug. 8, 2008 (EP) ..... 08162126

(51) Int. Cl.
*C10M 149/14* (2006.01)
*C10M 149/04* (2006.01)
*C10M 149/00* (2006.01)

(52) U.S. Cl.
USPC ..... 508/469; 508/470; 508/471; 508/473; 508/474; 508/475

(58) Field of Classification Search
USPC ..... 508/459, 464, 469, 470, 471, 473, 474, 508/475, 591; 123/1 A
See application file for complete search history.

(56) References Cited

U.S. PATENT DOCUMENTS

| | | | |
|---|---|---|---|
| 2,384,577 | A | 9/1945 | Thomas |
| 2,710,872 | A | 6/1955 | Thompson |
| 2,786,866 | A | 3/1957 | Hook et al. |
| 2,897,152 | A | 7/1959 | Elliot et al. |
| 3,219,666 | A | 11/1965 | Norman et al. |
| 3,356,702 | A | 12/1967 | Farmer et al. |
| 3,407,222 | A | 10/1968 | Lies |
| 3,509,051 | A | 4/1970 | Farmer et al. |
| 3,565,804 | A | 2/1971 | Honnen et al. |
| 3,607,749 | A | 9/1971 | Forbes |
| 3,697,574 | A | 10/1972 | Piasek et al. |
| 3,736,357 | A | 5/1973 | Piasek et al. |
| 3,867,359 | A | 2/1975 | Beadle |
| 4,031,020 | A | 6/1977 | Sugiura et al. |
| 4,098,705 | A | 7/1978 | Sakurai et al. |
| 4,164,473 | A | 8/1979 | Coupland et al. |
| 4,178,258 | A | 12/1979 | Papay et al. |
| 4,234,435 | A | 11/1980 | Meinhardt et al. |
| 4,259,195 | A | 3/1981 | King et al. |
| 4,261,843 | A | 4/1981 | King et al. |
| 4,263,152 | A | 4/1981 | King et al. |
| 4,265,773 | A | 5/1981 | deVries et al. |
| 4,266,945 | A | 5/1981 | Kam |
| 4,272,387 | A | 6/1981 | King et al. |
| 4,283,295 | A | 8/1981 | deVries et al. |
| 4,285,822 | A | 8/1981 | deVries et al. |
| 4,362,633 | A | 12/1982 | Spence et al. |
| 4,369,119 | A | 1/1983 | deVries et al. |
| 4,395,343 | A | 7/1983 | de Vries et al. |
| 4,402,840 | A | 9/1983 | deVries et al. |
| 4,466,901 | A | 8/1984 | Hunt et al. |
| 4,611,031 | A | 9/1986 | Galluccio |
| 4,636,322 | A | 1/1987 | Nalesnik |
| 4,692,256 | A | 9/1987 | Umemura et al. |
| 4,758,362 | A | 7/1988 | Butke |
| 4,765,918 | A | 8/1988 | Love et al. |
| 4,776,967 | A | 10/1988 | Ichihashi et al. |
| 4,867,890 | A | 9/1989 | Colclough et al. |
| 4,876,375 | A | 10/1989 | Lam |
| 4,885,365 | A | 12/1989 | Lam |
| 4,889,647 | A | 12/1989 | Rowan et al. |
| 4,927,552 | A | 5/1990 | Lam |
| 4,957,643 | A | 9/1990 | Lam |
| 4,966,719 | A | 10/1990 | Coyle et al. |
| 4,978,464 | A | 12/1990 | Coyle et al. |
| 4,990,271 | A | 2/1991 | Francis |
| 4,995,996 | A | 2/1991 | Coyle et al. |
| 5,108,635 | A | 4/1992 | Gabillet et al. |
| 5,137,647 | A | 8/1992 | Karol |
| 5,412,130 | A | 5/1995 | Karol |
| 5,520,832 | A | 5/1996 | Alexander |
| 5,627,259 | A | 5/1997 | Thaler et al. |
| 5,633,326 | A | 5/1997 | Patil et al. |
| 5,643,859 | A | 7/1997 | Gutierrez et al. |

(Continued)

FOREIGN PATENT DOCUMENTS

| | | | |
|---|---|---|---|
| EP | 330522 | B1 | 8/1989 |
| EP | 1916291 | A1 | 4/2008 |
| WO | WO 2008050003 | A2 * | 5/2008 |

OTHER PUBLICATIONS

Viscoplex 8-251 Evonik Industries (2008).*

(Continued)

*Primary Examiner* — Pamela H Weiss
(74) *Attorney, Agent, or Firm* — Luedeka Neely Group, P.C.

(57) ABSTRACT

A lubricant composition, additive concentrate, and method for lubricating an engine. The crankcase lubricant has less than 30 weight percent of a relatively low Noack volatility base oil and a viscosity additive. The viscosity additive has a minor effective amount of sacrificial polymeric viscosity index improver having a shear stability index (SSI) of greater than about 45 and a major amount of a viscosity index improver having an SSI of less than about 26. The minor amount of sacrificial viscosity index improver additive is effective to provide a lubricant composition having a ratio of absolute viscosity increase at 40° C. to an absolute viscosity increase at 40° C. of an RL 216 reference oil of less than about 0.8.

9 Claims, No Drawings

(56) References Cited

U.S. PATENT DOCUMENTS

| | | | | |
|---|---|---|---|---|
| 5,686,397 | A | 11/1997 | Baranski et al. | |
| 5,693,598 | A | 12/1997 | Abraham et al. | |
| 5,789,357 | A | 8/1998 | Baranski et al. | |
| 5,792,729 | A | 8/1998 | Harrison et al. | |
| 5,851,965 | A | 12/1998 | Harrison et al. | |
| 5,853,434 | A | 12/1998 | Harrison et al. | |
| 5,888,946 | A * | 3/1999 | Zakarian et al. | 508/469 |
| 5,902,776 | A | 5/1999 | Dohner et al. | |
| 5,936,041 | A | 8/1999 | Diana et al. | |
| 6,103,674 | A | 8/2000 | Nalesnik et al. | |
| 6,117,826 | A | 9/2000 | Baranski et al. | |
| 6,153,565 | A | 11/2000 | Skinner et al. | |
| 6,232,276 | B1 | 5/2001 | Stiefel et al. | |
| 6,281,179 | B1 | 8/2001 | Skinner et al. | |
| 6,323,164 | B1 | 11/2001 | Liesen et al. | |
| 6,429,178 | B1 | 8/2002 | Skinner et al. | |
| 6,429,179 | B1 | 8/2002 | Skinner et al. | |
| 6,509,303 | B1 | 1/2003 | Gatto | |
| 6,528,463 | B1 | 3/2003 | Gatto et al. | |
| 6,599,865 | B1 | 7/2003 | Esche, Jr. et al. | |
| 6,797,677 | B2 | 9/2004 | Esche, Jr. et al. | |
| 7,214,649 | B2 | 5/2007 | Loper et al. | |
| 7,402,235 | B2 | 7/2008 | Huang | |
| 2004/0259742 | A1 * | 12/2004 | Mishra et al. | 508/231 |
| 2004/0266630 | A1 | 12/2004 | George et al. | |
| 2005/0119138 | A1 * | 6/2005 | Ritchie et al. | 508/545 |
| 2006/0142168 | A1 * | 6/2006 | Kinker et al. | 508/466 |
| 2008/0015131 | A1 | 1/2008 | Vinci et al. | |
| 2009/0270294 | A1 * | 10/2009 | Souchez et al. | 508/469 |

OTHER PUBLICATIONS

Vlscoplex 0-220 Evonik Industries (2008).*

Spectrasyn Ultra 150 Product Safety Summary ExxonMobile Chemical (2010).*

ACEA European Oil Sequences 2008 European Automobile Manufactuers Association.*

Viscoplex 8-251 Evopnik Industries (2008).*

Viscoplex 0-220 Evonick Industries (2008).*

Spectrasyn Ultra 150 Product Safety Summary ExxonMobile (2010).*

Chevron UCBO 4R 7R (date unknown offered as an evidentiary reference).*

Viscoplex 0-220 Evonick and Viscoplex 8-251 Evonick (2008).*

Spectrasyn Ultra 150 Product Safety Summary ExxonMobile(2010).*

ACEA European Oil Sequences 2008 European Automobile Manufacturers Assoc.*

* cited by examiner

LUBRICANT ADDITIVE COMPOSITIONS HAVING IMPROVED VISCOSITY INDEX INCREASE PROPERTIES

TECHNICAL FIELD

The disclosure relates to an additive composition comprising at least two viscosity index improvers, and in particular to lubricant additive compositions that provide improved viscosity index properties for meeting crankcase oil performance specifications when using relatively low levels of Group III and/or Group IV base oils.

BACKGROUND AND SUMMARY

The European ACEA engine oil specifications require passing a lubricant engine test called the PEUGEOT TU5. The PEUGEOT TU5 test is based on a 1.6 liter, 4 cylinder gasoline engine to which a fixed charge of engine oil has been added. The engine is run for 72 hours at full load conditions with the oil temperature held at 150° C. No oil top up is allowed during the test. The increase in engine oil viscosity over the 72 hour period is measured and must be below proscribed limits in order for the test to comply with the ACEA specifications. The viscosity limits are set in terms of Absolute Viscosity Increase (measured in $mm^2$/sec) relative to the viscosity increase of reference oil.

Although some oil chemical oxidation of the oil may take place during the test, the primary mechanism for viscosity increase using the PEUGEOT TU5 test is believed to be a physical one. Contact between the hot blow-by gases and the lubricant may cause heat induced evaporation of light base oil & concentration of heavy oil components in the oil sump oil. The use of chemical additives such as antioxidants is generally not effective to control what is believed to be a physical mechanism for viscosity increase.

Relatively high shear stability index (SSI) olefin copolymer (OCP) viscosity index improvers (VII's) may help limit the viscosity increase experienced during the PEUGEOT TU5 test, however, in order to be effective, the additive package may require that a majority of the additive package be the OCP VII. Such an amount of high SSI OCP VII's in the additive package may be detrimental to providing a lubricant that can also pass a BOSCH 30 cycle shear test which is also found in the ACEA engine oil specifications. High SSI OCP VII's are typically not compatible with other additive package components and may have to be blended into the oil separately from the additive concentrate. Another disadvantage of using a significant amount of OCP VII is that the OCP component may make it difficult to meet the 3.5 minimum HTHS requirements of 10W30 ACEA A3/B3 oils.

Other viscosity index improvers that may be useful for limiting the viscosity increase experienced during the PEUGEOT TU5 test are tri-block copolymers of hydrogenated isoprene-styrene. However, such tri-block copolymers are a relatively expensive component with limited availability. Accordingly, in order to pass the ACEA European oil sequence test, relatively low SSI OCP VII's must be used with larger amounts of more expensive base oils such as hydrocracked Group III and/or polyalphaolefin (PAO) Group IV base oils having relatively lower Noack volatilities.

With regard to the foregoing, embodiments of the disclosure may provide a lubricant composition, additive concentrate, and method for lubricating an engine. The crankcase lubricant has less than 30 weight percent of a relatively low Noack volatility base oil and a viscosity additive. The viscosity additive has a minor effective amount of sacrificial polymeric viscosity index improver having a shear stability index (SSI) of greater than about 45 and a major amount of a viscosity index improver having an SSI of less than about 26. The minor amount of sacrificial viscosity index improver additive is effective to provide a lubricant composition having a ratio of absolute viscosity increase at 40° C. to an absolute viscosity increase at 40° C. of an RL 216 reference oil of less than about 0.8.

In another embodiment, the disclosure provides an additive concentrate for a lubricant. The additive concentrate includes a sacrificial polymeric viscosity index improver having a shear stability index (SSI) of greater than about 45 and major amount of a viscosity index improver having an SSI of less than about 26. A fully formulated lubricant containing the viscosity additive concentrate includes a major amount of base oil having a Noack volatility ranging from about 7.0 to about 15 wt. %. The additive concentrate is effective to provide a lubricant composition having a ratio of absolute viscosity increase at 40° C. to an absolute viscosity increase at 40° C. of an RL 216 reference oil of less than about 0.8.

Yet another embodiment of the disclosure provides a method for lubricating an engine. According to the method, a lubricant composition is provided that includes a major amount of base oil having a Noack volatility ranging from about 7.0 to about 15 weight percent and a viscosity additive for the base oil. The viscosity additive has an effective amount of sacrificial polymeric viscosity index improver having a shear stability index (SSI) of greater than about 45 and a major amount of viscosity index improver having an SSI of less than about 26. The viscosity additive is effective to provide a lubricant composition having a ratio of absolute viscosity increase at 40° C. to an absolute viscosity increase at 40° C. of an RL 216 reference oil of less than about 0.8.

Exemplary embodiments of the disclosure described herein relate to the use of a relatively low treat rate of a relatively high SSI dispersant viscosity index improver additive in combination with one or more conventional relatively low SSI viscosity index improvers as a means to reduce an absolute viscosity increase of a crankcase lubricant when performing a PEUGEOT TU5 engine test. Hence the disclosure enables the use of relatively low cost, less shear stable viscosity index improvers as the bulk viscosity index improver for the lubricant composition without the need for major quantities of relatively low volatility base oils being present in the final formulation.

DETAILED DESCRIPTION OF EXEMPLARY EMBODIMENTS

As described in more detail below, it is believed that use of a low treat rate of a relatively high shear stability index (SSI) polymeric dispersant viscosity index improver (VII) may act as a "sacrificial VII" in order to provide a passing grade in the PEUGEOT TU5 engine test. The high SSI polymeric dispersant VII is thought to fracture extremely easily under the thermal shear conditions that the oil experiences in the TU5 test, and hence is referred to as a "sacrificial VII" for the purposes of maintaining a lower absolute viscosity increase during the test. The loss of thickening power caused by this fracturing of polymer chains manifests itself as a drop in the viscosity of the oil in the first 12 hours of the test. As a result of the specific way the ACEA viscosity increase formulas for the TU5 are set, any reduction of viscosity in the first 12 hours of the test results in a net reduction in absolute viscosity increase.

The polymeric dispersant VII may be selected from an olefin copolymer VII, polyalkyl(meth)acrylate VII, styrene-maleic ester VII, hydrogenated styrene isoprene polymer VII, and mixtures of the foregoing products. Also suitable for use herein can be at least one dispersant/antioxidant VII. The polymeric dispersant VII may be supplied in the form of a solution in an inert solvent, typically a mineral oil solvent, which usually is a severely refined mineral oil. The viscosity index improver solution as received may typically have a viscosity of about 500 to about 1500 $mm^2$/sec and a specific gravity of less than 1 at 25° C.

One suitable relatively high SSI polymeric dispersant VII that may be used in relatively minor amounts in a dispersant/inhibitor (DI) package according to the disclosure is a copolymer of polyalkyl(meth)acrylates. The copolymer may include (A) from about 5 to about 15, weight percent $C_1$-$C_4$ alkyl methacrylate(s); (B) from about 75 to about 85, weight percent of $C_{10}$ to $C_{15}$ alkyl(meth)acrylate(s); (C) about 2 to about 8 weight percent $C_{16}$ to $C_{20}$ alkyl(meth)acrylates; and (D) from about 2 to about 5 weight percent of a nitrogen-containing dispersant monomer.

As used herein, $C_{10}$ to $C_{15}$ alkyl(meth)acrylate means an alkyl ester of acrylic or methacrylic acid having a straight or branched alkyl group of 10 to 15 carbon atoms per group including, but not limited to, decyl(meth)acrylate, isodecyl (meth)acrylate, undecyl(meth)acrylate, lauryl(meth)acrylate, myristyl(meth)acrylate, dodecyl pentadecyl methacrylate, and mixtures thereof. The $C_{16}$ to $C_{20}$ alkyl(meth)acrylate means an alkyl ester of acrylic or methacrylic acid having a straight or branched alkyl group of 16 to 20 carbon atoms per group including, but not limited to, cetyl(meth)acrylate, stearyl(meth)acrylate, palmitoleyl(meth)acrylate, isostearyl (meth)acrylate, elaidyl(meth)acrylate, oleyl(meth)acrylate, linoleyl(meth)acrylate, elaidolinoleyl(meth)acrylate, ricinoleyl(meth)acrylate, and mixtures thereof.

The alkyl(meth)acrylate comonomers containing 10 or more carbon atoms in the alkyl group are generally prepared by standard esterification procedures using technical grades of long chain aliphatic alcohols, and these commercially available alcohols are mixtures of alcohols of varying chain lengths in the alkyl groups. Consequently, for the purposes of disclosed embodiments, alkyl(meth)acrylate is intended to include not only the individual alkyl(meth)acrylate product named, but also to include mixtures of the alkyl(meth)acrylates with a predominant amount of the particular alkyl(meth) acrylate named.

The nitrogen-containing dispersant monomers suitable for use in providing the dispersant VII include dialkylamino alkyl (meth)acrylamides such as, N,N-dimethylaminopropyl methacrylamide; N,N-diethylaminopropyl methacrylamide; N,N-dimethylaminoethyl acrylamide and N,N-diethylaminoethyl acrylamide; and dialkylaminoalkyl(meth)acrylates such as N,N-dimethylaminoethyl methacrylate; N,N-diethylaminoethyl acrylate and N,N-dimethylaminoethyl thiomethacrylate.

The polyalkyl(meth)acrylate copolymers of described herein may consist essentially of the reaction products of (A), (B), (C), and (D). However, those skilled in the art will appreciate that minor levels of other monomers, polymerizable with monomers (A), (B) and/or (C), may be present as long as they do not adversely affect the dispersant VII properties of fully formulated fluids containing the copolymers. Typically additional monomers are present in an amount of less than about 5 weight percent. For example, the addition of minor levels of monomers such as $C_2$ to $C_9$ alkyl(meth)acrylates, hydroxy- or alkoxy-containing alkyl(meth)acrylates, ethylene, propylene, styrene, vinyl acetate may be included as long as the presence of these monomers do not adversely affect the properties of the copolymers.

The polyalkyl(meth)acrylate copolymers may be prepared by various polymerization techniques including free-radical and anionic polymerization. Conventional methods of free-radical polymerization may be used to prepare the copolymers. Polymerization of the acrylic and/or methacrylic monomers may take place under a variety of conditions, including bulk polymerization, solution polymerization, usually in an organic solvent, emulsion polymerization, suspension polymerization and non-aqueous dispersion techniques. An exemplary process for making the polyalkyl(meth)acrylate copolymers used herein is disclosed in U.S. Pat. No. 6,323,164 to Liesen, et al., the disclosure of which is incorporated herein by reference.

The polyalkyl(meth)acrylate copolymers for use herein typically have a relative number average molecular weight, as determined by gel permeation chromatography using polymethyl methacrylate standards, between 200,000 and 500,000 daltons, preferably from about 250,000 to about 400,000 daltons. Those skilled in the art will recognize that the molecular weights set forth throughout this specification are relative to the methods by which they are determined. For example, molecular weights determined by GPC and molecular weights calculated by other methods, may have different values. It is not molecular weight per se but the handling characteristics and performance of a polymeric additive (shear stability, low temperature performance and thickening power under use conditions) that is important. Generally, shear stability is inversely proportional to molecular weight. A VII additive with good shear stability (low SSI value) is typically used at higher initial concentrations relative to another additive having reduced shear stability (high SSI value) to obtain the same target thickening effect in a treated fluid at high temperatures; the additive having good shear stability may, however, produce unacceptable thickening at low temperatures due to the higher use concentrations.

Conversely, although lubricating oils containing lower concentrations of reduced shear stability VI improving additives may initially satisfy the higher temperature viscosity target, fluid viscosity may decrease significantly with use causing a loss of effectiveness of the lubricating oil. Thus, the reduced shear stability of specific VI improving additives may be satisfactory at low temperatures (due to its lower concentration) but it may prove unsatisfactory under high temperature conditions. Thus, polymer composition, molecular weight and shear stability of VI improvers must be selected to achieve a balance of properties in order to satisfy both high and low temperature performance requirements.

For the purposes of this disclosure, the number average molecular weight of the relatively high SSI polymeric dispersant VII may range from about 250,000 to about 400,000 daltons. A typical lubricant composition may contain from about 0.5 to about 3.0 weight percent of the relatively high SSI polymeric dispersant VII based on a total weight of the lubricant composition.

Other relatively high SSI's VII may be used as "sacrificial VII's" on the TU5 test. Accordingly, a lubricant composition according to the disclosure may include low treat rates of high SSI olefin copolymer (OCP) VII's, high SSI high-ethylene (OCP) VII's, high SSI dispersant OCP VII's, high SSI styrene-maleic ester VII's, high SSI hydrogenated styrene-isoprene VIIs, and the like. However, some of the OCP's VII that could be used may be less soluble in the DI packages than the above described polyalkyl(meth)acrylate copolymers and are thus less desirable to use.

Another important component of the lubricant compositions and additives of the disclosure is at least one dispersant or non-dispersant VII having a relatively low SSI. The relatively low SSI VII may be selected from ethylene-propylene copolymers, polyisobutenes, polymethacrylate acid esters, polyacrylate acid esters, diene polymers, polyalkyl styrenes, alkenyl aryl conjugated diene copolymers, polyolefins and multifunctional viscosity improvers having an SSI of less than about 26. In an embodiment, the dispersant VII may be an olefin copolymer or a functionalized olefin copolymer. The polymer or copolymer substrate may be prepared from ethylene and propylene or it can be prepared from ethylene and at least one higher olefin within the range of $C_3$ to $C_{23}$ alpha-olefins.

Non-limiting examples of polymers for use herein include copolymers of ethylene and at least one $C_3$ to $C_{23}$ alpha-olefins. In an embodiment, copolymers of ethylene and propylene may be used. Other alpha-olefins suitable in place of propylene to form the copolymer or to be used in combination with ethylene and propylene to form a terpolymer include 1-butene, 2-butene, isobutene, 1-pentene, 1-hexene, 1-octene and styrene; α, ω-diolefins such as 1,5-hexadiene, 1,6-heptadiene, 1,7-octadiene; branched chain alpha-olefins such as 4-methylbutene-1,5-methylpentene-1, and 6-methylheptene-1; and mixtures thereof.

The viscosity additive composition may comprise up to 75 wt. percent of relatively low SSI VII, for example from about 1 to about 60 wt. percent, and as a further example from about 10 to about 50 wt. percent.

In addition to the above ingredients, a DI package for a finished crankcase lubricant composition may other additives in addition to the copolymer VII's described above, e.g., oxidation inhibitors, corrosion inhibitors, friction modifiers, antiwear and extreme pressure agents, detergents, dispersants, antifoamants, and pour point depressants. Unlike transmission fluid compositions, the additives described herein are typically devoid of seal swell agents.

Accordingly, a typical crankcase lubricant formulation may include the following ingredients in the amounts listed in the following table:

TABLE 1

| Component | Wt. % (Broad) | Wt. % (Typical) |
|---|---|---|
| Dispersant | 0.5-10.0 | 1.0-5.0 |
| Antioxidant system | 0-5.0 | 0.01-3.0 |
| Metal Detergents | 0.1-15.0 | 0.2-8.0 |
| Corrosion Inhibitor | 0-5.0 | 0-2.0 |
| Metal dihydrocarbyl dithiophoshate | 0.1-6.0 | 0.1-4.0 |
| Ash-free amine phosphate salt | 0.1-6.0 | 0.1-4.0 |
| Antifoaming agent | 0-5.0 | 0.001-0.15 |
| Friction modifier | 0-5.0 | 0-2.0 |
| Supplemental antiwear agents | 0-1.0 | 0-0.8 |
| Pour point depressant | 0.01-5.0 | 0.01-1.5 |
| Relatively high SSI viscosity modifier | 0.01-5.0 | 0.5-3.0 |
| Relatively low SSI viscosity modifier | 0.1-20.0 | 5-15 |
| Supplemental friction modifier | 0-2.0 | 0.1-1.0 |
| Base oil | Balance | Balance |
| Total | 100 | 100 |

Base oils contemplated for use in the compositions and formulations described herein include natural oils, synthetic oils and mixtures thereof. Suitable base oils also include basestocks obtained by isomerization of synthetic wax and slack wax, as well as basestocks produced by hydrocracking (rather than solvent extracting) the aromatic and polar components of the crude. In general, both the natural and synthetic base oils each have a kinematic viscosity ranging from about 2 to about 20 $mm^2$/sec at 100° C., although typical applications will require each oil to have a viscosity ranging from about 4 to about 12 $mm^2$/sec at 100° C. For the purposes of the disclosure, the base oil may contain a minor amount of a relatively low Noack volatility base oil. By "minor amount" is meant that the base oil contains less than 30 percent by weight of a base oil having a Noack volatility of less than about 7 weight percent. Accordingly, a major amount of the base oil may have a Noack volatility ranging from about 7 to about 15 weight percent.

Dispersants

Dispersants contained in the DI package may include, but are not limited to, an oil soluble polymeric hydrocarbon backbone having functional groups that are capable of associating with particles to be dispersed. Typically, the dispersants comprise amine, alcohol, amide, or ester polar moieties attached to the polymer backbone often via a bridging group. Dispersants may be selected from Mannich dispersants as described, for example, in U.S. Pat. Nos. 3,697,574 and 3,736,357; ashless succinimide dispersants as described in U.S. Pat. Nos. 4,234,435 and 4,636,322; amine dispersants as described in U.S. Pat. Nos. 3,219,666, 3,565,804, and 5,633,326; Koch dispersants as described in U.S. Pat. Nos. 5,936,041, 5,643,859, and 5,627,259, and polyalkylene succinimide dispersants as described in U.S. Pat. Nos. 5,851,965; 5,853,434; and 5,792,729.

Detergents

One component of the DI package is a metal-containing or ash-forming detergent that functions as both a detergent to reduce or remove deposits and as an acid neutralizer or rust inhibitors, thereby reducing wear and corrosion and extending engine life. Detergents generally comprise a polar head with a long hydrophobic tail. The polar head comprises a metal salt of an acidic organic compound. The salts may contain a substantially stoichiometric amount of the metal in which case they are usually described as normal or neutral salts, and would typically have a total base number or TBN (as can be measured by ASTM D2896) of from 0 to 80. A large amount of a metal base may be incorporated by reacting excess metal compound (e.g., an oxide or hydroxide) with an acidic gas (e.g., carbon dioxide). The resulting overbased detergent comprises neutralized detergent as the outer layer of a metal base (e.g. carbonate) micelle. Such overbased detergents may have a TBN of 150 or greater, and typically will have a TBN of from 250 to 450 or more.

Detergents that may be used include oil-soluble neutral and overbased sulfonates, phenates, sulfurized phenates, thiophosphonates, salicylates, and naphthenates and other oil-soluble carboxylates of a metal, particularly the alkali or alkaline earth metals, e.g., barium, sodium, potassium, lithium, calcium, and magnesium. The most commonly used metals are calcium and magnesium, which may both be present in detergents used in a lubricant, and mixtures of calcium and/or magnesium with sodium. Particularly convenient metal detergents are neutral and overbased calcium sulfonates having TBN of from 20 to 450, neutral and overbased calcium phenates and sulfurized phenates having TBN of from 50 to 450 and neutral and overbased magnesium or calcium salicylates having a TBN of from 20 to 450. Combinations of detergents, whether overbased or neutral or both, may be used.

Detergents generally useful in the formulation of lubricating oil compositions also include "hybrid" detergents formed with mixed surfactant systems, e.g., phenate/salicylates, sulfonate/phenates, sulfonate/salicylates, sulfonates/phenates/salicylates, as described, for example, in U.S. Pat. Nos. 6,153,565, 6,281,179, 6,429,178 and 6,429,179.

It is not unusual to add a detergent or other additive, to a lubricating oil, or additive concentrate, in a diluent, such that only a portion of the added weight represents an active ingredient (A.I.). For example, detergent may be added together with an equal weight of diluent in which case the "additive" is 50% A.I. detergent. As used herein, the term weight percent (wt. %), when applied to a detergent or other additive refers to the weight of active ingredient. Detergents conventionally comprise from about 0.5 to about 5 wt. %, preferably from about 0.8 to about 3.8 wt. %, most preferably from about 1.2 to about 3 wt. % of a lubricating oil composition formulated for use in a heavy duty diesel engine.

Phosphorus-Containing Compounds

One component of the DI additive package may be a phosphorus-containing compound such as ZDDP. Suitable ZDDPs may be prepared from specific amounts of primary and secondary alcohols. For example, the alcohols may be combined in a ratio of from about 100:0 to about 0:100 primary-to-secondary alcohols. As an even further example, the alcohols may be combined in a ratio of about 60:40 primary-to-secondary alcohols. An example of a suitable ZDDP may comprise the reaction product obtained by combining: (i) about 50 to about 100 mol % of about $C_1$ to about $C_{18}$ primary alcohol; (ii) up to about 50 mol % of about $C_3$ to $C_{18}$ secondary alcohol; (iii) a phosphorus-containing component; and (iv) a zinc-containing component. As a further example, the primary alcohol may be a mixture of from about $C_1$ to about $C_{18}$ alcohols. As an even further example, the primary alcohol may be a mixture of a $C_4$ and a $C_8$ alcohol. The secondary alcohol may also be a mixture of alcohols. As an example, the secondary alcohol may comprise a $C_3$ alcohol. The alcohols may contain any of branched, cyclic, or straight chains. The ZDDP may comprise the combination of about 60 mol % primary alcohol and about 40 mol % secondary alcohol. In the alternative, the ZDDP may comprise 100 mol % secondary alcohols, or 100 mol % primary alcohols.

The phosphorus-containing component of the phosphorus-containing compound may comprise any suitable phosphorus-containing component such as, but not limited to a phosphorus sulfide. Suitable phosphorus sulfides may include phosphorus pentasulfide or tetraphosphorus trisulfide.

The zinc-containing component may comprise any suitable zinc-containing component such as, but not limited to zinc oxide, zinc hydroxide, zinc carbonate, zinc propylate, zinc chloride, zinc propionate, or zinc acetate.

The reaction product may comprise a resulting mixture, component, or mixture of components. The reaction product may or may not include unreacted reactants, chemically bonded components, products, or polar bonded components.

The ZDDP or ash-containing phosphorus compound may be present in an amount sufficient to contribute from about 0.03 wt % to about 0.15 wt % phosphorus in the lubricant composition.

In addition to, or in the alternative, an ash-free phosphorus compound may be included in a mixture of phosphorus-containing compounds. The ash-free phosphorus compound may be selected from an organic ester of phosphoric acid, phosphorous acid, or an amine salt thereof. For example, the ash-free phosphorus-containing compound may include one or more of a dihydrocarbyl phosphite, a trihydrocarbyl phosphite, a monohydrocarbyl phosphate, a dihydrocarbyl phosphate, a trihydrocarbyl phosphate, any sulfur analogs thereof, and any amine salts thereof. As a further example, the ash-free phosphorus-containing compound may include at least one or a mixture of monohydrocarbyl- and dihydrocarbyl phosphate amine salt, for example, an amyl acid phosphate salt may be a mixture of monoamyl acid phosphate salt and diamyl acid phosphate salt.

The mixture of phosphorus-containing compounds in the lubricating oil formulation may be present in an amount sufficient to provide from about 300 to about 1200 parts per million by weight of total phosphorus in the lubricating oil formulation. As a further example, the mixture of phosphorus-containing compounds may be present in an amount sufficient to provide from about 500 to about 800 parts per million by weight of total phosphorus in the lubrication oil formulation.

Oxidation Inhibitor Components

Oxidation inhibitors or antioxidants reduce the tendency of base stocks to deteriorate in service which deterioration can be evidenced by the products of oxidation such as sludge and varnish-like deposits that deposit on metal surfaces and by viscosity growth of the finished lubricant. Such oxidation inhibitors include hindered phenols, sulfurized hindered phenols, alkaline earth metal salts of alkylphenolthioesters having $C_5$ to $C_{12}$ alkyl side chains, sulfurized alkylphenols, metal salts of either sulfurized or nonsulfurized alkylphenols, for example calcium nonylphenol sulfide, ashless oil soluble phenates and sulfurized phenates, phosphosulfurized or sulfurized hydrocarbons, phosphorus esters, metal thiocarbamates, and oil soluble copper compounds as described in U.S. Pat. No. 4,867,890.

Other antioxidants that may be used in combination with the hydrocarbon soluble titanium compounds, include sterically hindered phenols and diarylamines, alkylated phenothiazines, sulfurized compounds, and ashless dialkyldithiocarbamates. Non-limiting examples of sterically hindered phenols include, but are not limited to, 2,6-di-tertiary butylphenol, 2,6 di-tertiary butyl methylphenol, 4-ethyl-2,6-di-tertiary butylphenol, 4-propyl-2,6-di-tertiary butylphenol, 4-butyl-2,6-di-tertiary butylphenol, 4-pentyl-2,6-di-tertiary butylphenol, 4-hexyl-2,6-di-tertiary butylphenol, 4-heptyl-2,6-di-tertiary butylphenol, 4-(2-ethylhexyl)-2,6-di-tertiary butylphenol, 4-octyl-2,6-di-tertiary butylphenol, 4-nonyl-2,6-di-tertiary butylphenol, 4-decyl-2,6-di-tertiary butylphenol, 4-undecyl-2,6-di-tertiary butylphenol, 4-dodecyl-2,6-di-tertiary butylphenol, methylene bridged sterically hindered phenols including but not limited to 4,4-methylenebis(6-tert-butyl-o-cresol), 4,4-methylenebis(2-tert-amyl-o-cresol), 2,2-methylenebis(4-methyl-6 tert-butylphenol, 4,4-methylenebis(2,6-di-tert-butylphenol) and mixtures thereof as described in U.S Publication No. 2004/0266630.

Diarylamine antioxidants include, but are not limited to diarylamines having the formula:

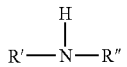

wherein R' and R" each independently represents a substituted or unsubstituted aryl group having from 6 to 30 carbon atoms. Illustrative of substituents for the aryl group include aliphatic hydrocarbon groups such as alkyl having from 1 to 30 carbon atoms, hydroxy groups, halogen radicals, carboxylic acid or ester groups, or nitro groups.

The aryl group is preferably substituted or unsubstituted phenyl or naphthyl, particularly wherein one or both of the aryl groups are substituted with at least one alkyl having from 4 to 30 carbon atoms, preferably from 4 to 18 carbon atoms, most preferably from 4 to 9 carbon atoms. It is preferred that one or both aryl groups be substituted, e.g. mono-alkylated diphenylamine, di-alkylated diphenylamine, or mixtures of mono- and di-alkylated diphenylamines.

The diarylamines may be of a structure containing more than one nitrogen atom in the molecule. Thus the diarylamine may contain at least two nitrogen atoms wherein at least one nitrogen atom has two aryl groups attached thereto, e.g. as in the case of various diamines having a secondary nitrogen atom as well as two aryls on one of the nitrogen atoms.

Examples of diarylamines that may be used include, but are not limited to: diphenylamine; various alkylated diphenylamines; 3-hydroxydiphenylamine; N-phenyl-1,2-phenylenediamine; N-phenyl-1,4-phenylenediamine; monobutyldiphenyl-amine; dibutyldiphenylamine; monooctyldiphenylamine; dioctyldiphenylamine; monononyldiphenylamine; dinonyldiphenylamine; monotetradecyldiphenylamine; ditetradecyldiphenylamine, phenyl-alpha-naphthylamine; monooctyl phenyl-alpha-naphthylamine; phenyl-beta-naphthylamine; monoheptyldiphenylamine; diheptyl-diphenylamine; p-oriented styrenated diphenylamine; mixed butyloctyldi-phenylamine; and mixed octylstyryldiphenylamine.

Another class of aminic antioxidants includes phenothiazine or alkylated phenothiazine having the chemical formula:

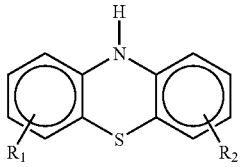

wherein $R_1$ is a linear or branched $C_1$ to $C_{24}$ alkyl, aryl, heteroalkyl or alkylaryl group and $R_2$ is hydrogen or a linear or branched $C_1$-$C_{24}$ alkyl, heteroalkyl, or alkylaryl group. Alkylated phenothiazine may be selected from the group consisting of monotetradecylphenothiazine, ditetradecylphenothiazine, monodecylphenothiazine, didecylphenothiazine, monononylphenothiazine, dinonylphenothiazine, monoctylphenothiazine, dioctylphenothiazine, monobutylphenothiazine, dibutylphenothiazine, monostyrylphenothiazine, distyrylphenothiazine, butyloctylphenothiazine, and styryloctylphenothiazine.

The sulfur containing antioxidants include, but are not limited to, sulfurized olefins that are characterized by the type of olefin used in their production and the final sulfur content of the antioxidant. High molecular weight olefins, i.e. those olefins having an average molecular weight of 168 to 351 g/mole, are preferred. Examples of olefins that may be used include alpha-olefins, isomerized alpha-olefins, branched olefins, cyclic olefins, and combinations of these.

Alpha-olefins include, but are not limited to, any $C_4$ to $C_{25}$ alpha-olefins. Alpha-olefins may be isomerized before the sulfurization reaction or during the sulfurization reaction. Structural and/or conformational isomers of the alpha olefin that contain internal double bonds and/or branching may also be used. For example, isobutylene is a branched olefin counterpart of the alpha-olefin 1-butene.

Sulfur sources that may be used in the sulfurization reaction of olefins include: elemental sulfur, sulfur monochloride, sulfur dichloride, sodium sulfide, sodium polysulfide, and mixtures of these added together or at different stages of the sulfurization process.

Unsaturated oils, because of their unsaturation, may also be sulfurized and used as an antioxidant. Examples of oils or fats that may be used include corn oil, canola oil, cottonseed oil, grapeseed oil, olive oil, palm oil, peanut oil, coconut oil, rapeseed oil, safflower seed oil, sesame seed oil, soyabean oil, sunflower seed oil, tallow, and combinations of these.

The amount of sulfurized olefin or sulfurized fatty oil delivered to the finished lubricant is based on the sulfur content of the sulfurized olefin or fatty oil and the desired level of sulfur to be delivered to the finished lubricant. For example, a sulfurized fatty oil or olefin containing 20 weight % sulfur, when added to the finished lubricant at a 1.0 weight % treat level, will deliver 2000 ppm of sulfur to the finished lubricant. A sulfurized fatty oil or olefin containing 10 weight % sulfur, when added to the finished lubricant at a 1.0 weight % treat level, will deliver 1000 ppm sulfur to the finished lubricant. It is preferred to add the sulfurized olefin or sulfurized fatty oil to deliver between 200 ppm and 2000 ppm sulfur to the finished lubricant. The foregoing aminic, phenothiazine, and sulfur containing antioxidants are described for example in U.S. Pat. No. 6,599,865.

The ashless dialkyldithiocarbamates which may be used as antioxidant additives include compounds that are soluble or dispersable in the additive package. It is also preferred that the ashless dialkyldithiocarbamate be of low volatility, preferably having a molecular weight greater than 250 daltons, most preferably having a molecular weight greater than 400 daltons. Examples of ashless dithiocarbamates that may be used include, but are not limited to, methylenebis(dialkyldithiocarbamate), ethylenebis(dialkyldithiocarbamate), isobutyl disulfide-2,2'-bis(dialkyldithiocarbamate), hydroxyalkyl substituted dialkyldithiocarbamates, dithiocarbamates prepared from unsaturated compounds, dithiocarbamates prepared from norbornylene, and dithiocarbamates prepared from epoxides, where the alkyl groups of the dialkyldithiocarbamate can preferably have from 1 to 16 carbons. Examples of dialkyldithio-carbamates that may be used are disclosed in the following patents: U.S. Pat. Nos. 5,693,598; 4,876,375; 4,927,552; 4,957,643; 4,885,365; 5,789,357; 5,686,397; 5,902,776; 2,786,866; 2,710,872; 2,384,577; 2,897,152; 3,407,222; 3,867,359; and 4,758,362.

Examples of suitable ashless dithiocarbamates are: Methylenebis-(dibutyldithiocarbamate), Ethylenebis(dibutyldithiocarbamate), Isobutyl disulfide-2,2'-bis(dibutyldithiocarbamate), Dibutyl-N,N-dibutyl-(dithiocarbamyl) succinate, 2-hydroxypropyl dibutyldithiocarbamate, Butyl (dibutyldithiocarbamyl)acetate, and S-carbomethoxy-ethyl-N,N-dibutyl dithiocarbamate. The most preferred ashless dithiocarbamate is methylenebis(dibutyldithiocarbamate).

Organomolybdenum containing compounds used as friction modifiers may also exhibit antioxidant functionality. U.S. Pat. No. 6,797,677 describes a combination of organomolybdenum compound, alkylphenothizine and alkyldiphenylamines for use in finished lubricant formulations. Examples of suitable molybdenum containing friction modifiers are described below under friction modifiers.

Friction Modifier Components

A sulfur- and phosphorus-free organomolybdenum compound that may be used as a friction modifier, if desired, may be prepared by reacting a sulfur- and phosphorus-free molybdenum source with an organic compound containing amino and/or alcohol groups. Examples of sulfur- and phosphorus-free molybdenum sources include molybdenum trioxide, ammonium molybdate, sodium molybdate and potassium molybdate. The amino groups may be monoamines, diamines, or polyamines. The alcohol groups may be monosubstituted alcohols, diols or bis-alcohols, or polyalcohols. As an example, the reaction of diamines with fatty oils produces a product containing both amino and alcohol groups that can react with the sulfur- and phosphorus-free molybdenum source.

Examples of sulfur- and phosphorus-free organomolybdenum compounds include compounds described in the following patents: U.S. Pat. Nos. 4,259,195; 4,261,843; 4,164,473; 4,266,945; 4,889,647; 5,137,647; 4,692,256; 5,412,130; 6,509,303; and 6,528,463.

Molybdenum compounds prepared by reacting a fatty oil, diethanolamine, and a molybdenum source as described in U.S. Pat. No. 4,889,647 are sometimes illustrated with the following structure, where R is a fatty alkyl chain, although the exact chemical composition of these materials is not fully known and may in fact be multi-component mixtures of several organomolybdenum compounds.

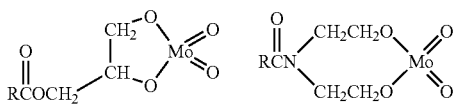

Sulfur-containing organomolybdenum compounds may be used and may be prepared by a variety of methods. One method involves reacting a sulfur and phosphorus-free molybdenum source with an amino group and one or more sulfur sources. Sulfur sources can include for example, but are not limited to, carbon disulfide, hydrogen sulfide, sodium sulfide and elemental sulfur. Alternatively, the sulfur-containing molybdenum compound may be prepared by reacting a sulfur-containing molybdenum source with an amino group or thiuram group and optionally a second sulfur source. Examples of sulfur- and phosphorus-free molybdenum sources include molybdenum trioxide, ammonium molybdate, sodium molybdate, potassium molybdate, and molybdenum halides. The amino groups may be monoamines, diamines, or polyamines. As an example, the reaction of molybdenum trioxide with a secondary amine and carbon disulfide produces molybdenum dithiocarbamates. Alternatively, the reaction of $(NH_4)_2Mo_3S_{13}*n(H_2O)$ where n varies between 0 and 2, with a tetralkylthiuram disulfide, produces a trinuclear sulfur-containing molybdenum dithiocarbamate.

Examples of sulfur-containing organomolybdenum compounds include compounds described in the following patents: U.S. Pat. Nos. 3,509,051; 3,356,702; 4,098,705; 4,178,258; 4,263,152; 4,265,773; 4,272,387; 4,285,822; 4,369,119; 4,395,343; 4,283,295; 4,362,633; 4,402,840; 4,466,901; 4,765,918; 4,966,719; 4,978,464; 4,990,271; 4,995,996; 6,232,276; 6,103,674; and 6,117,826.

Glycerides may also be used alone or in combination with other friction modifiers. Suitable glycerides include glycerides of the formula:

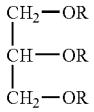

wherein each R is independently selected from the group consisting of H and C(O)R' where R' may be a saturated or an unsaturated alkyl group having from 3 to 23 carbon atoms. Examples of glycerides that may be used include glycerol monolaurate, glycerol monomyristate, glycerol monopalmitate, glycerol monostearate, and mono-glycerides derived from coconut acid, tallow acid, oleic acid, linoleic acid, and linolenic acids. Typical commercial monoglycerides contain substantial amounts of the corresponding diglycerides and triglycerides. These materials are not detrimental to the production of the molybdenum compounds, and may in fact be more active. Any ratio of mono- to di-glyceride may be used, however, it is preferred that from 30 to 70% of the available sites contain free hydroxyl groups (i.e., 30 to 70% of the total R groups of the glycerides represented by the above formula are hydrogen). A preferred glyceride is glycerol monooleate, which is generally a mixture of mono, di, and tri-glycerides derived from oleic acid, and glycerol.

Other Additives

Rust inhibitors selected from the group consisting of nonionic polyoxyalkylene polyols and esters thereof, polyoxyalkylene phenols, and anionic alkyl sulfonic acids may be used.

A small amount of a demulsifying component may be used. A preferred demulsifying component is described in EP 330,522. Such demulsifying component may be obtained by reacting an alkylene oxide with an adduct obtained by reacting a bis-epoxide with a polyhydric alcohol. The demulsifier should be used at a level not exceeding 0.1 mass % active ingredient. A treat rate of 0.001 to 0.05 mass % active ingredient is convenient.

Pour point depressants, otherwise known as lube oil flow improvers, lower the minimum temperature at which the fluid will flow or can be poured. Such additives are well known. Typical of those additives which improve the low temperature fluidity of the fluid are $C_8$ to $C_{18}$ dialkyl fumarate/vinyl acetate copolymers, polyalkylmethacrylates and the like.

Foam control can be provided by many compounds including an antifoamant of the polysiloxane type, for example, silicone oil or polydimethyl siloxane.

The following non-limiting examples and comparative data are given for the purpose of demonstrating the effectiveness of the additives for achieving suitable engine test performance results.

EXAMPLE

In the following example, 11.2 to 11.5 weight percent of the DI packages plus the indicated VII's, was added to certain base oils and the characteristics of the formulations were determined. The formulations were tested in the PEUGEOT TU5 engine test. The 15W50 base oils are generally accepted as the most difficult viscosity grade oil to pass the TU5 test. The base oil for Run 1, for Run 3, and for Run 4 included 20 wt. % Group III base oil and about 60 wt. % Group II base oils. The base oil for Run 2 and for Run 6 included 30 wt. % Group III base oils and about 50 wt. % Group II base oils. Run 5 included 40 wt. % of Group III base oils and about 40 wt. % Group II base oils. Results are given in the following table.

TABLE 2

| | Run 1 | Run 2 | Run 3 | Run 4 | Run 5 | Run 6 |
|---|---|---|---|---|---|---|
| Base oil | 15W50 | 15W50 | 15W50 | 10W40 | 10W40 | 15W50 |
| Group II base oil (Noack 13.4 wt %) | 6.95 | 8.40 | 2.85 | 0 | 0 | 0 |

TABLE 2-continued

| | Run 1 | Run 2 | Run 3 | Run 4 | Run 5 | Run 6 |
|---|---|---|---|---|---|---|
| Group II base oil (Noack 3.7 wt. %) | 52.50 | 41.40 | 57.80 | 0 | 0 | 0 |
| Group II base oil (Noack 24.2 wt. %) | 0 | 0 | 0 | 31.00 | 0 | 3.65 |
| Group II base oil (Noack 11.7 wt. %) | 0 | 0 | 0 | 0 | 16.35 | 0 |
| Group II base oil (Noack 2.7 wt. %) | 0 | 0 | 0 | 29.0 | 24.3 | 46.9 |
| Group III base oil (Noack 16 wt. %) | 10.00 | 0 | 10.00 | 10.0 | 20.0 | 15.0 |
| Group III base oil (Noack 15.3 wt. %) | 10.00 | 0 | 10.00 | 10.0 | 20.0 | 0 |
| Group III base oil (Noack 8 wt. %) | 0 | 30.00 | 0 | 0 | 0 | 15.0 |
| High SSI dispersant VII | 0 | 0 | 1.50 | 0 | 0 | 1.5 |
| Non-dispersant olefin copolymer VII | 8.95 | 8.60 | 6.25 | 8.7 | 8.05 | 6.35 |
| Balance of DI package ingredients | 11.6 | 11.6 | 11.6 | 11.3 | 11.3 | 11.6 |
| Total | 100.00 | 100.00 | 100.00 | 100.0 | 100.0 | 100.0 |
| KV at 100° C. ($mm^2$/sec) | 18.06 | 17.99 | 18.01 | 14.21 | 14.05 | 17.99 |
| KV at 40° C. ($mm^2$/sec) | 140.10 | 138.70 | 135.70 | 98.99 | 97.39 | 136.4 |
| CCS at 20° C. (mPa-sec) | 6909 | 6835 | 6885 | — | — | 6914 |
| CCS at 25° C. (mPa-sec) | — | — | — | 6967 | 6955 | — |
| MRV-25 (mPa-sec) | 26400 | 29200 | 23700 | — | — | 20200 |
| MRV-30 (mPa-sec) | — | — | — | 23800 | 27300 | — |
| MRV-25 yield stress (Pa) | <35 | <35 | <35 | — | — | <35 |
| MRV-30 yield stress (Pa) | — | — | — | <35 | <35 | — |
| Noack volatility (wt. %) | 7.6 | 6.6 | 7.5 | 13.0 | 10.4 | 7.4 |
| TBN (mg KOH/gram) | 9.6 | 9.5 | 9.6 | 9.6 | 8.6 | 9.7 |
| Calcium (ppm) | 24 | 25 | 23 | 22 | 25 | 24 |
| Phosphorus (ppm) | 838 | 838 | 770 | 753 | 793 | 747 |
| Zinc (ppm) | 918 | 918 | 882 | 857 | 913 | 851 |
| Magnesium (ppm) | 1577 | 1490 | 1348 | 1345 | 1411 | 1267 |
| Boron (ppm) | 98 | 100 | 96 | 100 | 103 | 97 |
| Molybdenum (ppm) | 97 | 93 | 95 | 85 | 90 | 91 |
| Sulphur (ppm) | 2860 | 3314 | 3138 | 3915 | 4108 | 2482 |
| Peugeot TU5 Engine Test (ACEA A3) | | | | | | |
| Ring stick - Test oil | 10.0 | 10.0 | 10.0 | 10.0 | 10.0 | 10.0 |
| Piston cleanliness - Test oil | 9.1 | 9.3 | 8.7 | 9.0 | 9.0 | 8.9 |
| KV at 40° C. increase ($mm^2$/sec) - Test oil | 93.8 | 50.4 | 58.1 | 148.2 | 98.6 | 56.0 |
| Piston cleanliness - RL 216 | 6.4 | 7.1 | 7.1 | 7.1 | 7.1 | 6.9 |
| KV at 40° C. increase ($mm^2$/sec) - RL 216 | 74.5 | 74.1 | 74.1 | 74.1 | 74.1 | 71.2 |
| KV at 40° C. of test oil:RL 216 (Ratio) | 1.26 | 0.68 | 0.78 | 2.00 | 1.33 | 0.79 |
| Test Status | A3 Fail | A3 Pass | A3 Pass | A3 Fail | A3 Fail | A3 Pass |

Run 1, Run 4, and Run 5 all had an Absolute Viscosity Increase at 40° C. of greater than 90 $mm^2$/sec. and a ratio of viscosity increase of the test oil at 40° C. to the viscosity increase of the reference oil at 40° C. of greater than 0.8 even when using a 20 to 40 wt. % of high volatility Group III base oils, i.e., base oils having a Noack volatility of greater than about 15 wt. %. Accordingly, the oil and additive of Runs 1, 4 and 5 failed to meet the requirements of the ACEA A3 specification. The oil and additive of Run 4 also failed to meet the ACEA A2 requirements.

In Run 2, a base oil containing 30 wt. % Group III base oil having a Noack volatility of about 8 wt. % was used with a conventional olefin copolymer VII. The reduced Noack volatility of the lubricant composition due to the relatively high amount of Group III base oil caused the Absolute Viscosity Increase at 40° C. to be 50.4 $mm^2$/sec and the ratio of viscosity increase of the test oil at 40° C. to the viscosity increase of the reference oil at 40° C. to be less than 0.8. As shown in Table 2, the Run 2 formulation was able to achieve the ACEA A3 specification limits.

In Run 3, 20 wt. % of the Group III base oils having a Noack volatility of greater than 15 wt. % was used in the lubricant composition. The additive included 1.5 wt. % high SSI dispersant VII in addition to the conventional OCP VII. Run 3 had an Absolute Viscosity Increase at 40° C. of 58.1 $mm^2$/sec and a ratio of viscosity increase of the test oil at 40° C. to the viscosity increase of the reference oil at 40° C. of less than 0.8. Accordingly, the additive in the base oil of Run 3 enabled the lubricant composition to meet or exceed the ACEA A3 specification limits. Accordingly, it is believed that the combination of the conventional OCP VII with 1.5 wt. % high SSI dispersant VII will enable a lubricant composition to pass an ACEA A3 PEUGEOT TU5 pass without having to resort to increased levels of relatively expensive Group III base oils having Noack volatilities of less than 15 wt. %.

Run 6 had 15 wt. % Group III base oil having a Noack volatility of 16 wt. %, 15 wt. % Group III base oil having a Noack volatility of 8 wt. %, and 50 wt. % Group II base oils. Run 6 also included 1.5 wt. % of the high SSI dispersant VII in addition to the conventional OCP VII. The absolute viscosity increase at 40° C. in Run 6 was 56.0 $mm^2$/sec and the ratio of viscosity increase of the test oil at 40° C. to the reference oil at 40° C. was less than 0.8. Accordingly, the additive in the base oil mixture of Run 6 also passed the ACEA A3 and A2 requirements.

The disclosed additive composition may be added to a lubricating composition as a top treat. A top treat, as used herein, is a fluid composition that may be added to a partially or a fully formulated (finished) lubricating fluid. A top treat may be added at any time. For example, a top treat may be added by the manufacturer, e.g., as a factory fill; by the end user, e.g., as a service fill; or by any other party desiring to impart the properties of the top treat to a fluid.

The lubricating compositions described herein may be effective in a variety of applications including crankcase lubricating oils for spark-ignited and compression-ignited internal combustion engines, two-cycle engines, aviation piston engines, marine and low-load diesel engines, and the like.

Lubricant compositions, such as modern motor oils, may be made by combining a pre-formed additive package with a refined or synthetic base oil stock. A lubricant composition may also comprise various different lubricant additive packages. Because lubricant additives can be easier to handle and measure in liquid form those additives which are normally solid can be dissolved in small amounts of base oil stock.

For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

It is noted that, as used in this specification and the appended claims, the singular forms "a," "an," and "the," include plural referents unless expressly and unequivocally limited to one referent. Thus, for example, reference to "an antioxidant" includes two or more different antioxidants. As used herein, the term "include" and its grammatical variants are intended to be non-limiting, such that recitation of items in a list is not to the exclusion of other like items that can be substituted or added to the listed items.

While particular embodiments have been described, alternatives, modifications, variations, improvements, and substantial equivalents that are or can be presently unforeseen can arise to applicants or others skilled in the art. Accordingly, the appended claims as filed and as they can be amended are intended to embrace all such alternatives, modifications variations, improvements, and substantial equivalents.

What is claimed is:

1. A lubricant composition comprising (i) a base oil that is devoid of 30 weight percent or more of a Group III base oil, a Group IV base oil, or a mixture thereof, wherein each of the Group III base oil and Group IV base oil have a Noack volatility of 15 wt. % or less and (ii) a viscosity additive comprising (a) from about 0.5 to about 3.0 wt. % of a polymeric viscosity index improver having a shear stability index (SSI) of greater than about 45 comprising a shear stable, dispersant polyalkyl(meth)acrylate viscosity index improver that is a polymeric reaction product of butylmethacrylate, lauryl methacrylate, cetyl methacrylate, and dimethylaminopropyl methacrylamide and (b) from about 5 to about 15 wt. % of a viscosity index improver having an SSI of less than about 26 based on a total weight of the lubricant composition, comprising an olefin copolymer viscosity index improver derived from ethylene and an olefin having from about 3 to about 23 carbon atoms, and wherein the viscosity index improver having an SSI of greater than about 45 is effective to provide a crankcase lubricant composition for an engine oil with an absolute viscosity increase at 40° C. of less than about 90 $mm^2$/sec. and a ratio of absolute viscosity increase at 40° C. relative to an absolute viscosity increase at 40° C. of an RL 216 reference oil in a PEUGEOT TU5 engine test of less than about 0.8.

2. The lubricant composition of claim 1, wherein the lubricant composition further comprises at least one component selected from the group consisting of overbased detergents, antioxidants, dispersants, extreme pressure agents, wear reduction agents, antifoaming agents, friction modifying agents, pour-point depressants, and combinations thereof.

3. The lubricant composition of claim 1 wherein the poly (alkyl)methacrylate viscosity index improver has a number average molecular weight ranging from about 250,000 to about 400,000 daltons.

4. A viscosity additive concentrate for a lubricant composition, the additive concentrate comprising (a) from about 2.5 to about 15.0 wt. % of a polymeric viscosity index improver having a shear stability index (SSI) of greater than about 45 comprising a shear stable, dispersant polyalkyl(meth)acrylate viscosity index improver that is a polymeric reaction product of butylmethacrylate, lauryl methacrylate, cetyl methacrylate, and dimethylaminopropyl methacrylamide and (b) from about 25 to about 75 wt. % of a viscosity index improver having an SSI of less than about 26 based on a total weight of the additive concentrate comprising an olefin copolymer viscosity index improver derived from ethylene and an olefin having from about 3 to about 23 carbon atoms, and wherein a fully formulated crankcase lubricant composition for an engine oil containing the viscosity additive concentrate is effective to provide the lubricant composition comprising the additive concentrate and a base oil of lubricating viscosity that is devoid of 30 weight percent or more of a Group III base oil, a Group IV base oil, or a mixture thereof, wherein each of the Group III base oil and Group IV base oil have a Noack volatility of 15 wt. % or less with an absolute viscosity increase at 40° C. of less than about 90 $mm^2$/sec. and a ratio of absolute viscosity increase at 40° C. to an absolute viscosity increase at 40° C. of an RL 216 reference oil in a PEUGEOT TU5 engine test of less than about 0.8.

5. A lubricant additive comprising the additive concentrate of claim 4 and further comprising at least one component selected from the group consisting of overbased detergents, antioxidants, detergents, extreme pressure agents, wear reduction agents, antifoaming agents, friction modifying agents, pour-point depressants, and combinations thereof.

6. The additive concentrate of claim 4 wherein the poly (alkyl)methacrylate viscosity index improver has a number average molecular weight ranging from about 250,000 to about 400,000 daltons.

7. A method for lubricating an engine, comprising providing to an engine crankcase a lubricant composition comprising (i) a base oil of lubricating viscosity that is devoid of 30 weight percent or more of a Group III base oil, a Group IV base oil, or a mixture thereof, wherein each of the Group III base oil and Group IV base oil have a Noack volatility of 15 wt. % or less and (ii) a viscosity additive comprising (a) from about 0.5 to about 3.0 wt. % of polymeric viscosity index improver having a shear stability index (SSI) of greater than about 45 comprising a shear stable, dispersant polyalkyl (meth)acrylate viscosity index improver that is a polymeric reaction product of butylmethacrylate, laurel methacrylate, cetyl methacrylate, and dimethylaminopropyl methacrylamide and (b) from about 5 to about 15 wt. % of a viscosity index improver having an SSI of less than about 26 based on a total weight of the lubricant composition, comprising an olefin copolymer viscosity index improver derived from ethylene and an olefin having from about 3 to about 23 carbon atoms, and wherein the viscosity index improver having an SSI of greater than about 45 is effective to provide a lubricant composition for an engine oil with an absolute viscosity increase at 40° C. of less than about 90 $mm^2$/sec. and a ratio of absolute viscosity increase at 40° C. to an absolute viscosity increase at 40° C. of an RL 216 reference oil in a PEUGEOT TU5 engine test of less than about 0.8; and operating the engine.

8. The method of claim 7, wherein the lubricant composition further comprises at least one component selected from the group consisting of overbased detergents, antioxidants, dispersants, extreme pressure agents, wear reduction agents, antifoaming agents, friction modifying agents, pour-point depressants, and combinations thereof.

9. The method of claim 7, wherein the poly(alkyl)methacrylate viscosity index improver has a number average molecular weight ranging from about 250,000 to about 400,000 daltons.

* * * * *